US005289835A

United States Patent [19]

Harlan et al.

[11] Patent Number: 5,289,835

[45] Date of Patent: Mar. 1, 1994

[54] TOOL SET FOR COLORING HAIR

[76] Inventors: Thomas A. Harlan, 6 Leafdale Pt., Austin, Tex. 78738; Marc L. Bridges, Rte. 1, Box 167A, Dale, Tex. 78616; Joseph F. Long, 1335 Lost Creek Blvd., Austin, Tex. 78746

[21] Appl. No.: 723,857

[22] Filed: Jul. 1, 1991

[51] Int. Cl.[5] ..... A45D 44/18

[52] U.S. Cl. ..... 132/313; 132/112; 132/116; 222/333; 222/390

[58] Field of Search ..... 132/112, 113, 114, 115, 132/116, 313, 320; 401/175, 176; 222/192, 333, 390; 206/219

[56] References Cited

U.S. PATENT DOCUMENTS

| | | | |
|---|---|---|---|
| 1,590,547 | 6/1926 | Prusso | 401/175 |
| 1,950,769 | 3/1934 | Baar | 222/390 |
| 2,196,379 | 4/1940 | Bender | 222/390 |
| 3,156,387 | 11/1964 | Harwood | 222/390 |
| 3,702,616 | 11/1972 | Mercer | 132/112 |
| 3,721,250 | 3/1973 | Walter et al. | 132/112 |
| 3,749,105 | 7/1973 | Sestita | 132/208 |
| 4,144,988 | 3/1979 | Bergman | 222/390 |
| 4,277,193 | 7/1981 | Knaus | 132/120 |
| 4,323,085 | 4/1982 | Rohm | 132/113 |
| 4,602,651 | 7/1986 | Roppatte, Jr. | 132/320 |
| 4,934,388 | 6/1990 | Gibbs | 132/112 |
| 4,996,996 | 3/1991 | Hirsh | 132/219 |
| 5,056,480 | 10/1991 | Murray, Sr. | 132/112 |

FOREIGN PATENT DOCUMENTS

| | | | |
|---|---|---|---|
| 3122516 | 12/1982 | Fed. Rep. of Germany | 132/320 |

*Primary Examiner*—Gene Mancene
*Assistant Examiner*—Frank A. LaViola
*Attorney, Agent, or Firm*—Joseph F. Long

[57] ABSTRACT

A tool set comprising modified combs to selectively lift portions of hair; calibrated manually operated color mixing tubes to measure each component of the hair coloring composition and mix and dispense; and a hair coloring brush, with a brush head attached to a calibrated battery activated dispensing handle with a switch located close to the brush head depressable to eject hair coloring mixture through the brush head to the base of bristles in the brush head.

4 Claims, 2 Drawing Sheets

TOOL SET FOR COLORING HAIR

BACKGROUND

For many years a large proportion of the female population and increasing portion of the male population have changed their appearance by selectively coloring part or all of their hair. At present, the hair dresser normally mixes the coloring solution using a developer and color mixture in a bowl type container and applies to portions of the hair with a brush similar to a normal paint brush. The mixture is quite expensive so he guesses at the minimum amount to be used. The actual amount varies from about one ounce of the mixture for highlighting to six or more ounces of the mixture for a total coloring job or longer hair. Quite generally, total coloring may actually be total coloring of a dispersed portion of the hair.

To color hair, the operator separates about a ⅛" by 3" segment, separates with a weaving comb a portion to be colored, places aluminum foil on his hand under the segment and brushes on the coloring with the other hand using a short bristle brush. The brush is reloaded from the mixer container. The present invention simplifies mixing, measuring and application of the color to the hair.

The objectives of this invention include:

1) a manual means to selectively lift a portion of hair starting near the roots;
2) a switch to feed an operator determinable amount of a hair color composition to a hair coloring brush;
3) a no-waste method for reproducible mixing from one to twelve ounces of materials forming differing colors of a hair coloring composition;
4) tools designed for rapid and complete aqueous clean up.

The special tools designed to meet these objectives include:

1) rat tail color weave combs with a portion of each comb containing teeth with hooked ends. Different combs have different spacings of the hooked teeth in order to separate greater or lesser portions of each tuft of hair as the tuft is manually separated;
2) a calibrated plunger operated mixing tube to allow an operator to add an exact chosen amount of a developer and a color in the tube and operate a manual plunger to mix to form a desired hair coloring composition;
3) a calibrated battery operated dispensing handle holding a minimum of one ounce of hair coloring composition releasably connected with a hair coloring brush containing openings to allow feeding the hair coloring composition in an operator determinable amount through the brush head at the base of the bristles in the brush head;
4) brush heads with bristles trimmed in shapes as desired by an operator;
5) a stand with a battery charger to recharge the batteries in the dispensing handle;
6) a tray to releasably hold color weave combs and the coloring brush, with handle attached, during intermittent usage.

We recognize that the battery operated dispensing handle and brush may also be advantageously used for a homeowner to paint small areas or for a commercial artist to paint large backgrounds on canvas.

We wish only to be limited to the general spirit and purpose of this invention since one with normal skill in the mechanical arts may visualize many minor changes and still accomplish the same purpose as the tools of this invention.

SUMMARY OF THE INVENTION

The invention comprises a set of tools for use by a hairdresser to save time and money as compared with presently available tools. Currently, hair is colored or painted with a coloring solution according to the desire of the patron. At times only a small portion on the head is colored and at times a small portion of most of the hair on the head is colored. The set of tools designed to simplify measuring, mixing and application of the color composition to a desired portion of hair are:

a) a rat tail weaving comb group with a portion of the teeth on each comb having hooked ends to lift hair and each comb having different spacing of the hooked end lifting teeth in order to lift from about one eighth to essentially all of a portion of hair separated by an operator and lay the separated portion back over a surface such as aluminum foil;

b) one or more mixing cylindrical tubes of about one inch in diameter and six inches long are etched, formed, or painted with lines about one eighth inch apart to allow using the tube as a measuring tube. In a preferred embodiment, the tube is equipped with a threaded discharge nozzle with a plug cock valve in the discharge nozzle to close the discharge during mixing. A perforated plate plunger type mixer and dispensing unit with a manually grippable upper end, such as a ring, extends through an upper closure for the tube. The perforated plate plunger is equipped with a rotatable plate to close the perforations by pulling the plunger to the top of the mixing tube and rotating against stop pins to position the rotatable plate to cover perforations in the lower-plate. At this time, an operator opens the discharge plug cock valve and may discharge the mixer tube. We have sized the mixing tube to hold about three ounces of a hair coloring mixture, but using the calibrations, an operator may reproducibly mix amounts as desired. Normally, two tubes of three ounces each would be mixed for larger jobs and only one tube of one ounce for smaller jobs.

c) a hair coloring brush with a calibrated dispensing means comprises:

1) a brush head with an opening in a threaded inlet nozzle leading through a channel to the base of bristles in the brush head. Usually, the brush head is flat with either equal length bristles or bristles cut at a slant. Other sizes and shapes are visualized for special purposes;
2) a transparent dispensing handle calibrated with a series of marks approximately one eighth inch apart on the longer axis, threadably, or otherwise, attached to the nozzle on the brush head. This dispensing handle preferably has a circular cross section with a guide groove to prevent rotation of a threaded plunger that moves up and down in the tube on a threaded shaft. A smooth eliptical cross section would also serve to prevent rotation as the plunger moves up and down by rotating a threaded shaft. The dispensing handle is preferably threadably closed with a filling nozzle containing a seal to rotatably seal an upper end of the threaded shaft with the upper end of the shaft being one half of a male-female connection. The filling nozzle is perferably internally threaded to close the dispensing handle and is externally threaded to allow threadably connecting to a driver cap. The driver cap, contains a battery and a D.C. motor with a shaft with one half of a male-female connector to driveably connect with the threaded central shaft when the driver cap is threaded onto the filling nozzle. Circuitry from the battery to the motor includes one or more switches. In one preferred embodiment, a switch in the driver cap drives the threaded shaft to raise the threaded plunger to the top of the dispensing handle to allow filling or cleaning and a second switch contained in or close to the brush head spring loaded open and depressable to close, to drive the threaded plunger downward to slowly eject a portion of the contents of the dispensing handle through the brush head to the base of the bristles. In a preferred embodiment, this switch is located at the very lower portion of the dispensing handle.

DETAILED DESCRIPTION OF THE DRAWING

The use and characteristics of the tools may best be described from the drawings.

Figure 1:
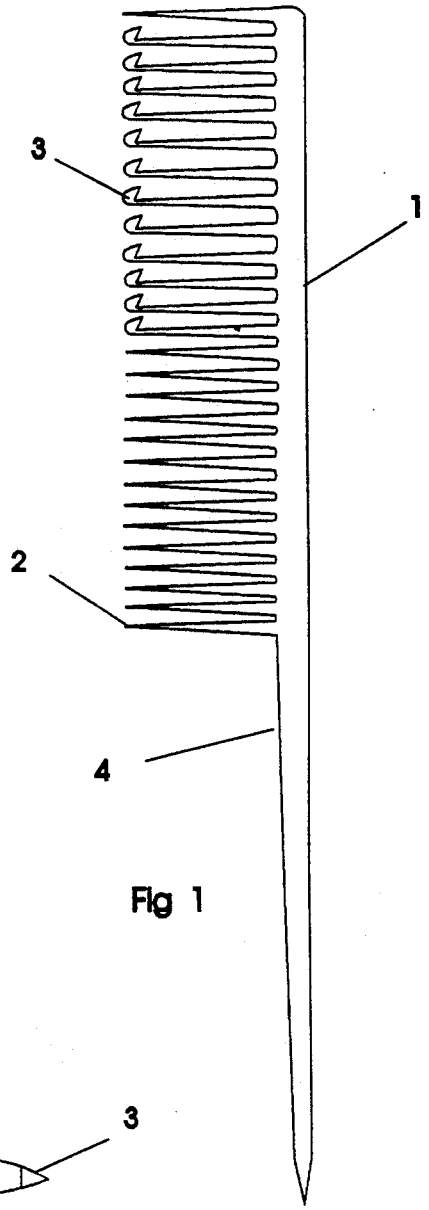
FIG. 1 shows a rat tail weaving comb with lifting teeth.

In FIG. 1 we show a weaving comb 1 with a rat tail end 4, normal teeth 3 and hooked ends 3 on spaced teeth. The hooked ends will lift a portion of the hair that the operator wishes to color. Wider spaced teeth will lift a lesser total portion.

Figure 2:
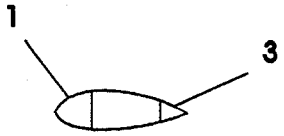
FIG. 2 shows cross section of the rat tail weaving comb.

In FIG. 2 we show a second A..A of comb 1 indicating hooked ends 3 and a nearly triangular comb back. The operator manually separates about a ⅛" by 2" tuft of hair and, using hooked end 3, selectively lifts up approximately ⅛" or more of the tuft and holds the lifted hair while using the comb back to aid in insertion of a non-absorbent sheet such as aluminum foil under the lifted hair preparatory to applying a coloring compound.

Figure 3:
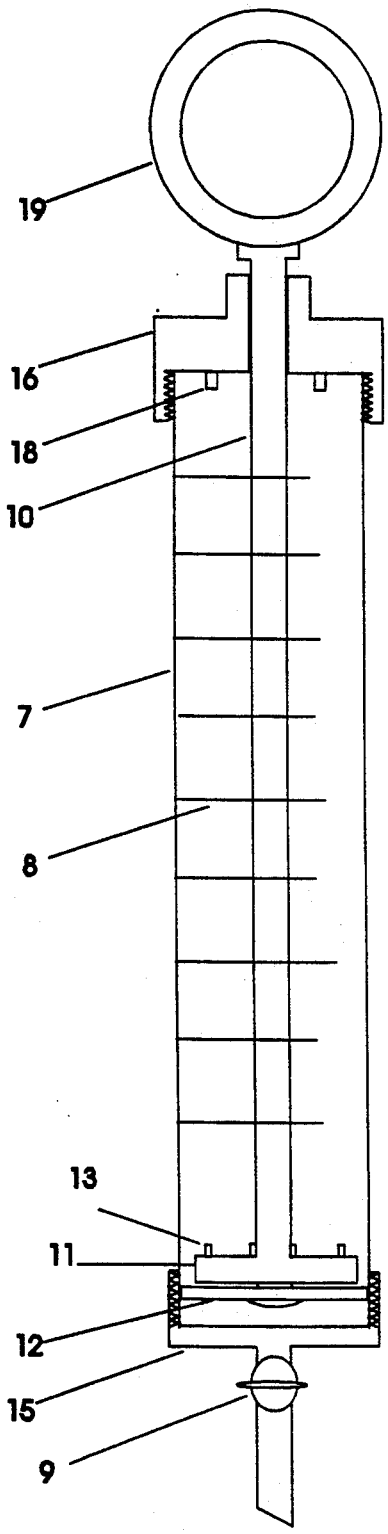
FIG. 3 shows a mixing and dispensing unit.

In FIG. 3 we show a calibrated manually operable mixing and dispensing tube 7 wherein filling cap 16 may be removed and, using calibration marks 8, an operator may add a measured amount of each part of a coloring composition after closing plug cock 9 in dispensing nozzle 15. After aligning perforations in lower perforated plate 12 with openings in the upper plate 11 of the plunger head, the shaft 10 may be inserted and moved in an up and down motion with threaded handle 19 to mix the contents as contents move through the perforations. It is important that the plunger head may be pushed very close to the discharge nozzle 15 to both mix and extrude essentially all the mixture. After mixing the shaft 10 is retracted and twisted so that interaction of projections 18 in the filling cap 16 and projections 13 on plate 11 cause rotation of plate 1 to cover perforations in plate 12. At this point, stop cock 9 is opened and downward motion of shaft 10 ejects the hair coloring composition.

Figure 4:
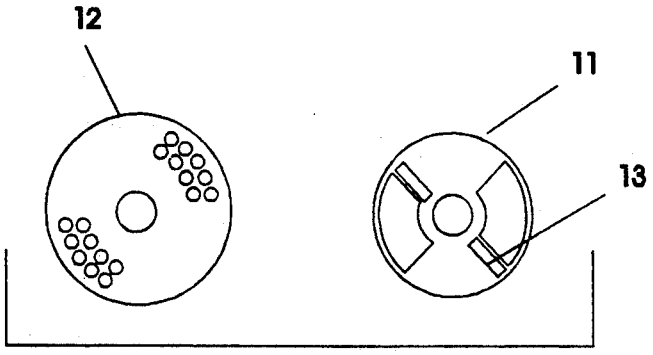
FIG. 4 shows cooperating segments of a perforated plunger for the mixing and dispensing unit.

FIG. 4 shows one preferred arrangement of openings on perforated plate 12 and rotatable plate 11 of the mixing and dispensing plunger head.

Figure 5:
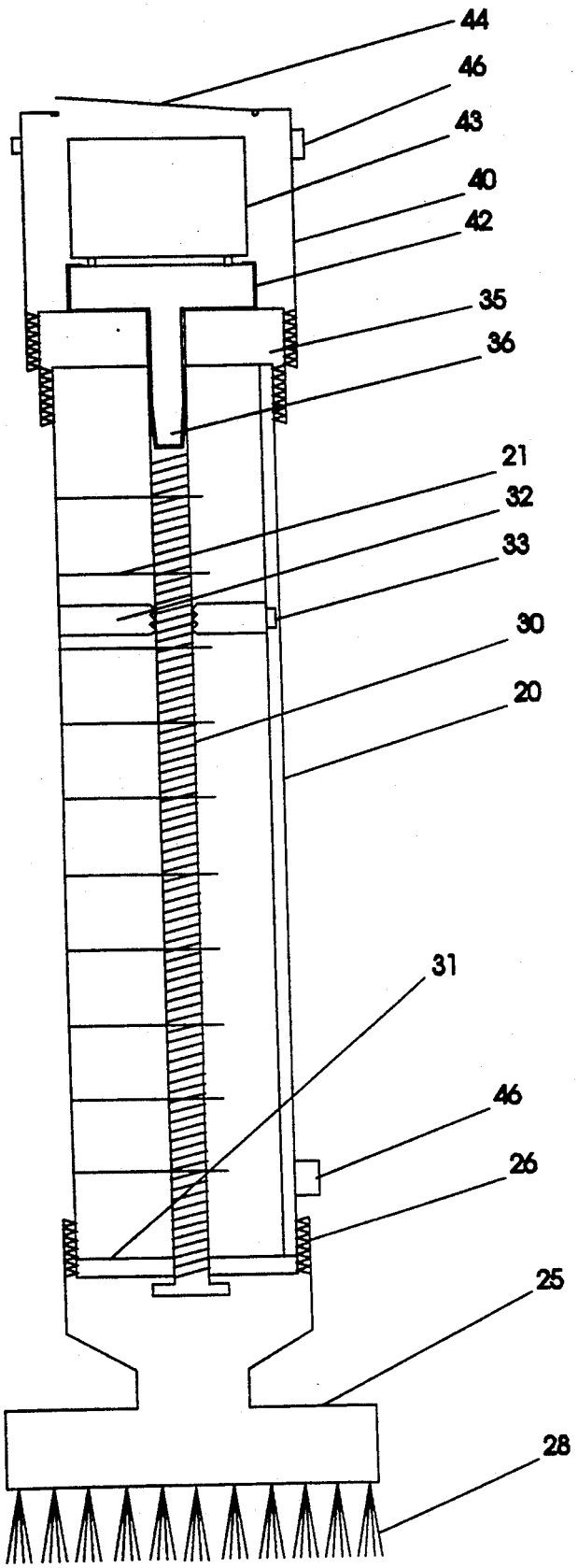
FIG. 5 shows a hair coloring brush with a dispensing handle.

In FIG. 5 we show a hair coloring brush wherein a hair coloring composition in dispensing handle 20 may be fed between the base of the bristles 27 in brush head 25 as threaded plunger 32 is moved downward by rotation of shaft 30. Shaft 30 goes through an open support spider 31 and up through a filling nozzle 35. An upper female connector 32 driveably connects with male connector 42 on a drive shaft from motor 41 located in driver cap 40 below battery 43. Snap closure 44 holds battery 43 in place. Switch 45 may be a depressable drive switch to operate battery driven motor 41 to drive plunger 32 downward to eject an amount of the hair coloring composition that could be judged from the calibrated marks 21. A retractor switch 46 in the driver cap 40 retracts the plunger 32 in order to fill tube 20 when necessary. Both switches could be replaced with one reversing switch, preferably located so the operator could operate the switch while holding the coloring brush near the brush head. Circuitry leading to a switch on the lower portion of the dispensing handle may be embedded along the dispensing handle using a quick setting resin or plastic. Not shown are connectors in driver cap to connect with circuitry embedded along the dispensing handle.

Figure 6:
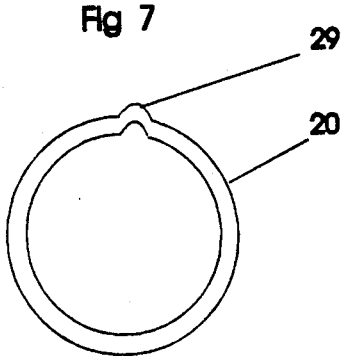
FIG. 6 shows cross sectional view of dispensing handle.

FIG. 6 shows a cross section of tube 20 with a guide channel 29 for pin 33, FIG. 5 to prevent rotation of threaded plunger 32, FIG. 5 as plunger 32 is driven up and down by rotation of threaded shaft 30, FIG. 5. A dispensing handle with a non-circular cross section may be used to obviate the necessity of a guide channel.

Figure 7:
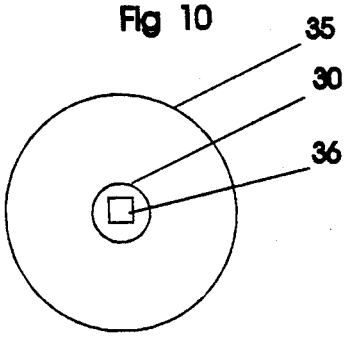
FIG. 7 shows a top view of the filling nozzle.

FIG. 7 shows a top view of filling nozzle 35 indicating square opening in female connector 36 on threaded shaft 30, FIG. 5.

Figure 8:
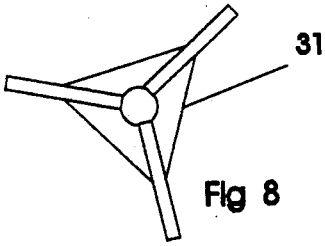
FIG. 8 shows a top view of the lower shaft support.

FIG. 8 shows a support spider 31 to hold rotatable shaft 30, FIG. 5, in a central position during operation. The open spider 31 is used to cause little friction as contents of tube 20 are pushed downward by downward movement of plunger 30.

Figure 9:
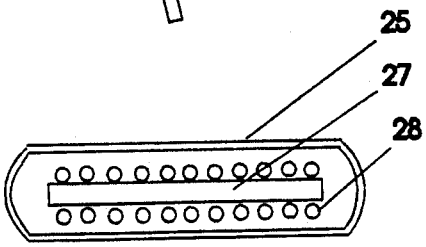
FIG. 9 shows cross sectional view of the brush head.

FIG. 9 shows a cross section at C..-C of brush head 25 indicating a discharge slot 27 that connects with nozzle 26, FIG. 5, to allow forcing contents of tube 20, FIG. 5, by operation of switch 45, FIG. 5 to feed hair coloring composition material near the base of bristles 28. Preferably there should be a minimum volume in the openings in the brush head 25 connecting slot 27 to tube 20.

Figure 10:
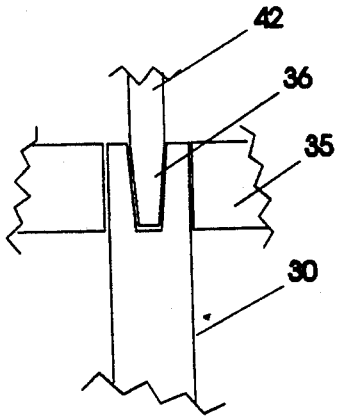
FIG. 10 shows detail of a male-female connector for connecting the motor shaft to the rotatable shaft.

FIG. 10 shows male connector 42 on the shaft of motor 41, FIG. 5, and female connector 36 on shaft 30 in filling cap 35.

LEGEND

FIG. 1
- 1=rat tail weaving comb
- 2=normal comb teeth
- 3=hooked end of spaced hooked comb teeth
- 4=rat tail handle FIG. 2 Section A—A of comb 1 showing triangle shaped back portion of comb 1 and hook 3 on teeth.

FIG. 3
- 7=transparent or translucent tube
- 8=calibration marks

9=plug cock valve
10=mixer shaft
11=upper rotatable plate of perforated plate plunger
12=lower perforated plate fixedly attached to shaft 10
13=projections 13
15=threaded dispensing nozzle
16=filling nozzle
18=projections for turning 13
19=handle threadably attached to shaft 10

FIG. 4
11=upper rotatable plate of perforated plate plunger
12=lower perforated plate fixedly attached
13=projections FIG. 5
20=transparent or translucent tube
21=calibration marks
25=brush head
26=nozzle on brush head
27=slotted opening connecting to nozzle 26
28=bristles
30=threaded shaft
31=lower support spider for threaded shaft
32=threaded plunger with rotation preventing pin
33=pin in plunger
35=filling nozzle
36=female connector on shaft 30
40=driver cap
41=D. C. motor
42=male connection on motor shaft
43=battery
44=snap closure for driver cap 40
45=depressable switch
46=retractor switch FIG. 6
20=tube
29=guide channel FIG. 7
30=shaft
35=filling cap
36=female connector FIG. 8
31=top view of support spider FIG. 9
25=cross section C—C of brush head
27=slotted opening
28=base of bristles 28, FIG. 5

What is claimed:

1. Improved hair coloring tool set comprising:

a) a plurality of hair weaving combs with a portion of teeth on each of said combs having hooked ends and with spacing of said teeth with hooked ends being varied to pick up from one eighth to all of hair as said hooked ends are moved to selectively lift hair to be colored;

b) a mixing tube comprising:

1) a calibrated tube;

2) a discharge nozzle threadably attached to a first end of said calibrated tube;

3) a plug cock valve in said discharge nozzle;

4) a filling nozzle with central circular opening threadably attached to a second end of said calibrated tube;

5) a mixing and dispensing means in said calibrated tube to mix components of a hair coloring composition and dispense said mixed composition;

c) a coloring brush comprising:

1) a brush head and a nozzle on said brush head; said brush head having openings leading from said nozzle to bristles in said brush head;

2) a calibrated dispensing handle means releasably attached to said nozzle;

3) a motor and a dispensing switch in said dispensing handle means, said switch being adjacent to said brush head to activate said motor cooperating with said calibrated dispensing handle means to dispense contents of said handle means when said dispensing switch is held in a closed position.

2. An improved hair coloring tool set comprising:

a) a plurality of weaving comb means to selectively lift a portion of hair being colored; said plurality of weaving comb means comprises combs with teeth having hooked ends and with graduated spacing of said teeth having said hooked ends allowing an operator to lift from about one-eighth to essentially all of a portion of hair separated for coloring; said portion of hair normally covering a portion of scalp approximately a minimum of one eighth by two inches;

b) a mixing tube means to mix components of a hair coloring composition for a chosen hair color for said portion of hair; said mixing tube means comprising:

1) a calibrated tube with marks approximately one eighth inch apart along a longer axes of said tube;

2) a discharge nozzle removeably attached to a first end of said calibrated tube;

3) a valve in said discharge nozzle;

4) a filling nozzle with stop pins and a central circular opening removeably attached to a second end of said calibrated tube;

5) a plunger head means comprising a first part consisting of a semi-flexible cup shaped unit sized to fit closely into said calibrated tube and rigidly attached to a first end of a shaft, said cup shaped unit having perforations sized to allow passage of a viscous liquid and said plunger head means having a second part that is shaped to twistably interact with said stop pins in said filling nozzle and is rotatably fastened to said shaft touching said semi-flexible cup shaped unit; said second part having openings larger than said openings in said cup shaped unit and being rotatable against said stop pins to align said openings in said semi-flexible cup shaped unit with openings in said second part and being rotatable to close said openings in said cup shaped unit; thereby allowing mixing by moving said plunger head means when openings in said cup shaped unit and second part are aligned and allowing closing of openings in said cup shaped unit whereby said plunger head means may be moved to eject contents of said calibrated tube;

6) a coloring brush with an automatic dispensing means for dispensing said hair coloring composition into bristles contained in said coloring brush; said automatic dispensing means being fillable from said mixing tube; said coloring brush and said automatic dispensing means comprises:

a) a brush head and a nozzle in said brush head; said brush head having an opening leading from said nozzle to a base of bristles in said brush head; said automatic dispensing means further comprising:

1) a calibrated dispensing handle releasably attached to said nozzle;
2) a filling nozzle releasably attached to first end of said calibrated dispensing handle;
3) a threaded central shaft with a female portion of a male-female connector on a first end, a lower support spider to rotatably support a second end of said shaft, and a seal contained in said filling nozzle to rotatably contain said first end of said shaft; said support spider having a minimum of three arms slideably contacting an inner wall of said calibrated dispensing handle;
4) a threaded plunger mounted on said threaded central shaft and sized to slideably and closely fit an interior of said calibrated dispensing handle; rotation of said central shaft causing said plunger to move along said central shaft;
5) a driver cap threadable engaging said filling nozzle;
6) a battery and motor in said driver cap; said motor having a shaft with an end terminating in a male connector to engage said female connector on said threaded central shaft when said cap is threadably engaged with said filling nozzle;
7) a switch in said brush head to cause said battery to drive said motor to move said threaded plunger in said calibrated dispensing handle downward and a switch attached to said calibrated dispensing handle to move said threaded plunger upward.

3. An improved hair coloring tool set comprising:

a) a plurality of weaving comb means to selectively lift a portion of hair being colored;
b) a mixing tube means to mix components of a hair coloring composition for a chosen hair color for said portion of hair; said mixing tube means comprising:
   1) a calibrated tube with marks approximately one eighth inch apart along a longer axes of said tube;
   2) a discharge nozzle removably attached to a first end of said calibrated tube;
   3) a valve in said discharge nozzle;
   4) a filling nozzle with stop pins and a central circular opening removably attached to a second end of said calibrated tube;
   5) a plunger head means comprising a first part consisting of a semi-flexible cup shaped unit sized to fit closely into said calibrated tube and rigidly attached to a first end of a shaft, said cup shaped unit having perforations sized to allow passage of a viscous liquid and said plunger head means having a second part that is shaped to twistably interact with said stop pins in said filling nozzle and is rotatably fastened to said shaft touching said semi-flexible cup shaped unit; said second part having openings larger than said openings in said cup shaped unit and being rotatable against said stop pins to align said openings in said semi-flexible cup shaped unit with openings in said second part and being rotatable to close said openings in said cup shaped unit; thereby allowing mixing by moving said plunger head means when openings in said cup shaped unit and second part are aligned and allowing closing of openings in said cup shaped unit whereby said plunger head means may be moved to eject contents of said calibrated tube;
   6) a coloring brush with a motor driven automatic dispensing means for dispensing said hair coloring composition into bristles contained in said coloring brush; said automatic dispensing means being fillable from said mixing tube.

4. An improved hair coloring tool set comprising:

a) a plurality of weaving comb means to selectively lift a portion of hair being colored;
b) a mixing tube means to mix components of a hair coloring composition for a chosen hair color for said portion of hair;
c) a coloring brush with a motor driven automatic dispensing means for dispensing said hair coloring composition into bristles contained in said coloring brush; said automatic dispensing means being fillable from said mixing tube; said coloring brush and said automatic dispensing means comprising:
   1) a brush head and a nozzle in said brush head; said brush head having an opening leading from said nozzle to a base of bristles in said brush head; said automatic dispensing means further comprising:
      a) a calibrated dispensing handle releasably attached to said nozzle;
      b) a filling nozzle releasably attached to a first end of said calibrated dispensing handle;
      c) a threaded central shaft with a female portion of a male-female connector on a first end, a lower support spider to rotatably support a second end of said shaft, and a seal contained in said filling nozzle to rotatably contain said first end of said shaft; said support spider having a minimum of three arms slidably contacting an inner wall of said calibrated dispensing handle;
      d) a threaded plunger mounted on said threaded central shaft and sized to slidably and closely fit an interior of said calibrated dispensing handle; rotation of said central shaft causing said plunger to move along said central shaft;
      e) a driver cap threadably engaging said filling nozzle;
      f) a battery and motor in said driver cap; said motor having a shaft with an end terminating in a male connector to engage said female connector on said threaded central shaft when said cap is threadably engaged with said filling nozzle;
      g) a switch in said brush head to cause said battery to drive said motor to move said threaded plunger in said calibrated dispensing handle upward and a switch attached to said calibrated dispensing handle to move said threaded plunger downward.

* * * * *